US006776091B2

(12) United States Patent
Goss

(10) Patent No.: US 6,776,091 B2
(45) Date of Patent: Aug. 17, 2004

(54) METHOD AND APPARATUS FOR SCREEN PRINTING NUMBERS

(76) Inventor: Duke W. Goss, 127 10th St. S., Kirkland, WA (US) 98033

( * ) Notice: Subject to any disclaimer, the term of this patent is extended or adjusted under 35 U.S.C. 154(b) by 0 days.

(21) Appl. No.: 10/215,172

(22) Filed: Aug. 7, 2002

(65) Prior Publication Data

US 2004/0025722 A1 Feb. 12, 2004

(51) Int. Cl.[7] ..... B05C 17/06
(52) U.S. Cl. ..... 101/128; 101/127.1
(58) Field of Search ..... 101/114, 115, 101/123, 126, 127.1, 128, 129, DIG. 36; 33/614, 617, 621

(56) References Cited

U.S. PATENT DOCUMENTS 4,084,505 A * 4/1978 Ichinose ..... 101/123
4,750,421 A * 6/1988 Lucas ..... 101/128
4,843,963 A * 7/1989 Hoeflein et al. ..... 101/128

* cited by examiner

*Primary Examiner*—Ren Yan
(74) *Attorney, Agent, or Firm*—Delbert J. Barnard

(57) ABSTRACT

An inner frame (38) is provided with a printing screen that includes a stencil of a numeral. An object to be printed (e.g. a shirt) is placed on a platen (P), in a substantially centered position with respect to an outer frame (10) having an open center (28). The inner frame (38) is positioned within the inner space (28) of the outer frame (10) and is fixed in position relative to the outer frame (10) so as to properly position the stencil with the object to be printed on the platen (P). Locator pins (82,84,86,88,90) and locator pin openings (92,94,96,98,100,102,104) are provided and arranged for establishing five possible positions of the inner frame (38) within the inner space (28) of the outer frame (10).

10 Claims, 6 Drawing Sheets

METHOD AND APPARATUS FOR SCREEN PRINTING NUMBERS

TECHNICAL FIELD

This invention relates to a method and apparatus for screen-printing numbers onto an object. More particularly, it relates to a screen-printing method and apparatus that are adapted to facilitate the screen-printing of both single and double-digit numbers onto t-shirts, sweatshirts, athletic jerseys and other objects.

BACKGROUND OF THE INVENTION

Examples of screen-printing apparatuses are shown by U.S. Pat. No. 5,355,791, granted Oct. 18, 1994, to John R. Benedetto and William Gillesple, and by U.S. Pat. No. 5,622,108, granted Apr. 22, 1997 to John R. Benedetto; William Gillesple, Jr.; James W. Pomeroy; Duke Goss and Charles J. Pomeroy. U.S. Pat. No. 5,622,108, for example, discloses a platen for supporting a textile fabric object that is to be screen-printed, e.g. a t-shirt, sweatshirt or athletic jersey. A print screen including a stencil is mounted to be set down onto the object to be printed. The stencil is of a design, letter, number, etc., that is to be printed on the object when ink is moved across the screen by use of a squeegee that forces the ink through small pores in the stencil.

There is a need for a screen printing apparatus and method for facilitating the printing of both single and double digit numbers. There is a need for a number printing system in which standard screen printing equipment can be easily and quickly set up and used to properly position the numbers relative to the object that is to receive them. A principal object of the present invention is to provide such a system.

BRIEF SUMMARY OF THE INVENTION

The system of the present invention is basically characterized by an outer frame that includes an inner space and an inner frame that includes a stencil and is sized to fit within the inner space of the outer frame. The inner frame is shiftable in position sideways within the inner space and is lockable in several selected positions relative to the outer frame.

In one embodiment, the outer frame includes spaced apart first and second support members that extend across the inner space between an opposite side pair of inner side members. A first inner side member is adapted to set down on and be supported by the first support member. A second inner side member that is across the inner frame from the first inner side member is adapted to set down on and be supported by the second support member.

The first inner side member and the first support member may include laterally spaced apart locator pins on one and laterally spaced apart locator pin openings on the other. The locator pins are selectively positionable within the locator pin openings, for adjustably affixing the position of the inner frame and stencil relative to the outer frame, lengthwise of the support members and laterally of an object to be printed.

In one embodiment of the invention, one of the locator pin openings has a width dimension in the length direction of the first support member that is substantially equal to a common width dimension of all the locator pins in the same direction. The remaining locator pin openings are preferably slots elongated in the length direction of the first support member and have a width dimension perpendicular to the length direction of the first support member that is substantially equal to the width dimension of the locator pins. Preferably, in this embodiment, the locator pins are cylindrical in shape and one of the locator pin openings is circular in shape and has a diameter substantially equal to the common diameter of the locator pins. The remaining locator pin openings are slots having semicircular ends substantially matching the locator pins in size and curvature.

In the preferred embodiment of the invention, there are five locator pins and seven locator pin openings. The center locator pin opening is the substantially circular opening and the remaining six locator pin openings are the slots that are elongated in the length direction of the first support member. Perpendicular to the support member, the slots are substantially equal in width and in width are substantially equal to the diameter of the circular opening.

According to an aspect of the invention, a printing screen that includes a stencil is connected to and supported by the inner frame and it includes a numeral to be printed. A separate inner frame, and thus a separate stencil, is provided for each numeral "0", "1", "2", "3", "4", "5", "6", "7", "8", and "9".

Other objects, advantages and features of the invention will become apparent from the description of the best mode set forth below from the drawings, from the claims and from the principles that are embodied in the specific structures that are illustrated and described.

BRIEF DESCRIPTION OF THE SEVERAL VIEWS OF THE DRAWING

Like reference numerals and letters are used to designate like parts throughout the several views of the drawing, and.

DETAILED DESCRIPTION OF THE INVENTION

Figure 1:
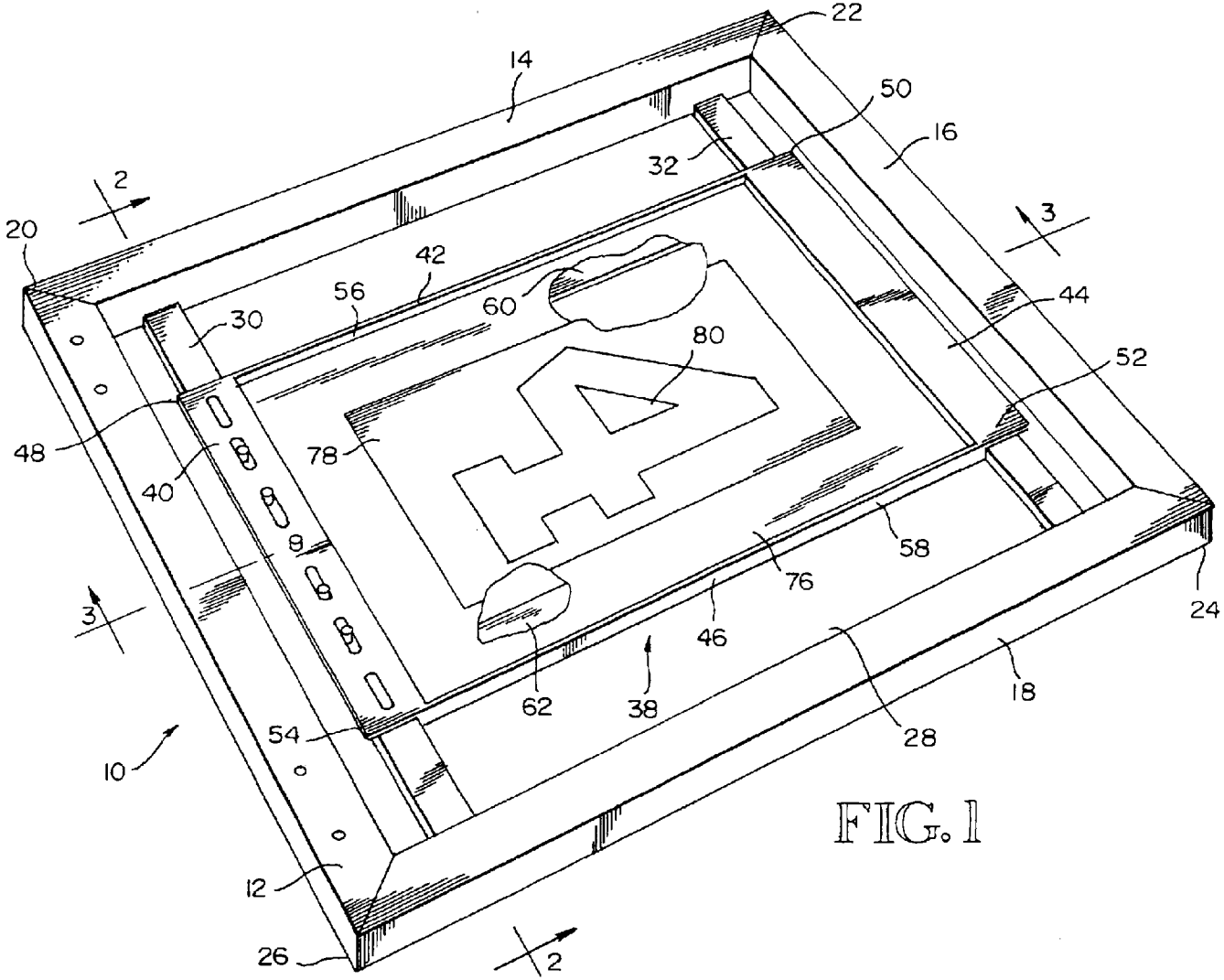
FIG. 1 is a pictorial view of a screen-printing assembly, taken from above and looking towards one end and one side of the assembly.

FIG. 1 shows an outer frame 10 comprising four outer side members 12,14,16,18 connected together at four corners 20,22,24,26. The outer side members 12,14,16,18 may be constructed from tubular material (FIG. 2) that is square in cross section, e.g. 1¼" by 1¼" aluminum tubing. The outer side members 12,14,16,18 define between them an inner space 28.

Figure 2:
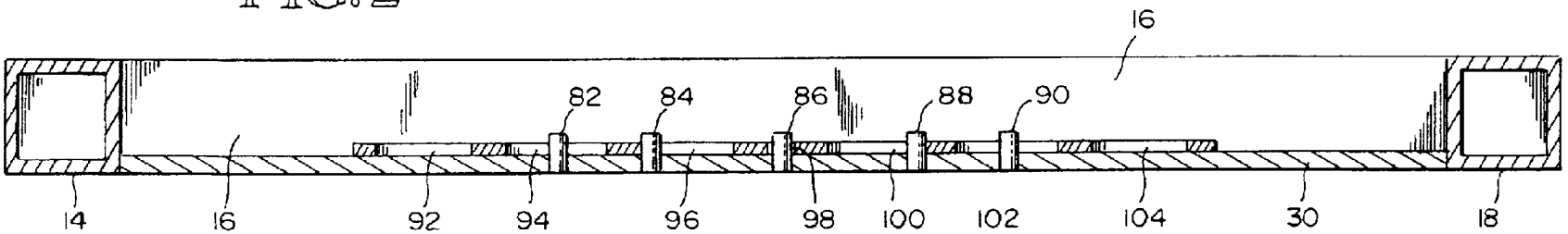
FIG. 2 is a sectional view taken substantially along line 2—2 of FIG. 1.
Figure 3:
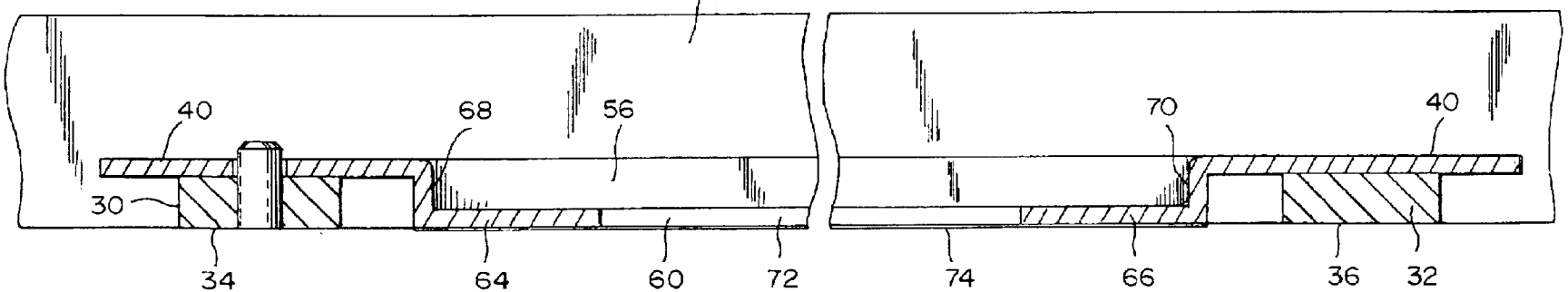
FIG. 3 is a sectional view taken substantially along line 3—3 of FIG. 1, with a central portion of the view being cut away in order to shorten the figure.

In the embodiment of FIGS. 1–7, first and second support members 30,32 extend across the inner space 28 perpendicular to outer side members 14,18 and parallel with outer side members 12,16. Support member 30 is adjacent outer side member 12 and support member 32 is adjacent outer side member 16. Support members 30,32 may be constructed from flat bar material, e.g. ¼" by 1" aluminum bar stock. The ends of the support members 30,32 are welded or otherwise firmly connected to the outer side members 14,18. As shown by FIG. 3, the lower surfaces 34,36 of the support members 30,32 are within a common plane that includes the lower surfaces of the outer side members 12,14,16,18.

An inner frame member 38 includes four side members 40,42,44,46 that are connected together at four corners 48,50,52,54. The inner side members 40,44 are flat and sit down on the support members 30,32. The inner side members 42,46 are preferably angle members. They include vertical flanges 56,58 and horizontal flanges 60,62 (FIG. 1). At their end, horizontal flanges 60,62 meet horizontal flanges 64,66. Vertical flanges 56,58 extend upwardly from horizontal flanges 60,62. Vertical webs 68,70 extend upwardly from horizontal flanges 64,66 and are connected to horizontal flanges 40,44 (FIG. 3). The horizontal flanges 60,62,64,66 and the vertical flanges 56,58,68,70 form a tray that is open at its center. This center opening is designated 72. Referring to FIG. 3, a printing screen 74 is secured to the lower surfaces of the tray members 60,62,64,66. When the end members 40,46 are on the support members 30,32, the lower surfaces of the horizontal flanges 60,62,64,66 and the lower surfaces of the support members 30,32, and the screen 74, are substantially at the same level, i.e. substantially within a common place.

In the illustrated example, the printing screen 74 is adapted to print the numeral "4." The pores of the screen 74 are open in the region where the numeral "4" appears. The screen pores are closed in the regions 76,78 surrounding the numeral "4" and in the center region 80 of the numeral "4". The open and closed pores form a stencil for the numeral "4". In regions 78,80 the pores may be closed by a paint that is applied to the screen. In the surrounding region 76 the pores may be closed by use of tape or tape and paint combined. Ink that is used to do the printing is introduced into the tray on top of the screen 74. This will be discussed in more detail later in this description.

Referring to FIG. 2, the support member 30 may be provided with a plurality of locator pins 82,84,86,88,90 that all extend vertically and have the same diameter or width dimension. Locator pin 86 is positioned substantially at the center of support member 30. Locator pins 84,88 are spaced outwardly of locator pin 86 along support member 30. Preferably, the spacing of a locator pin 84 from locator pin 86 is equal to the spacing of locator pin 88 from locator pin 86. Locator pin 82 is spaced outwardly from locator pin 84 and locator pin 90 is spaced outwardly from locator pin 88. Preferably, locator pin 82 is spaced away from locator pin 84 substantially the same distance that locator pin 90 is spaced away from locator pin 88. As shown by FIG. 1, the locator pins 82,84,86,88,90 are arranged in a straight line that extends lengthwise of the support member 30 and is parallel to the support members 30,32.

Inner frame side member 40 includes locator pin openings 92,94,96,98,100,102,104. Locator pin opening 98 is substantially equal in size and shape (e.g. circular shape) to the identical locator pins 82,84,86,88,90. Locator pin opening 98 is herein sometimes referred to as the "key" opening. Locator pin openings 92,94,96,100,102,104 are slots that are elongated in the length direction of the support member 30. The transverse dimension of the slots 92,94,96,100,102,104 is substantially equal to the width dimension or diameter of the locator pins 82,84,86,88,90. The locator pins 82,84,86, 88,90 and the locator pin openings 92,94,96,98,100,102,104 cooperate to mount the inner frame 38 in a particular position within the inner space 28 of the outer frame member 10.

FIGS. 1 and 2 show the center locator pin 86 within the substantially equally sized "key" opening 98 in the support member 30. Locator pin 82 is within locator pin opening 94. Locator pin 84 is within locator pin opening 96. Locator pin 88 is within locator pin opening 100. Locator pin 90 is within locator pin opening 102. Locator pins 84,88 are at the outside ends of the openings 96,100. The locator pins 84,86,88 and the locator pin openings 96,98,100 serve to lock the inner frame against all movement within the inner space 28 of the outer frame 10 in all directions except upwardly away from the support members 30,32. It can be moved upwardly.

Locator pins 82,84,86,88,90 and locator pin openings 94,96,98,100,102 all serve to lock the inner frame 38 against movement in the direction perpendicular to support members 30,32. The numeral "4" is positioned on the screen 74 such that when the inner frame is in the position shown by FIGS. 1 and 2, the numeral "4" is substantially centered relative to an object to be printed that is below the printing screen 74.

Figure 9:
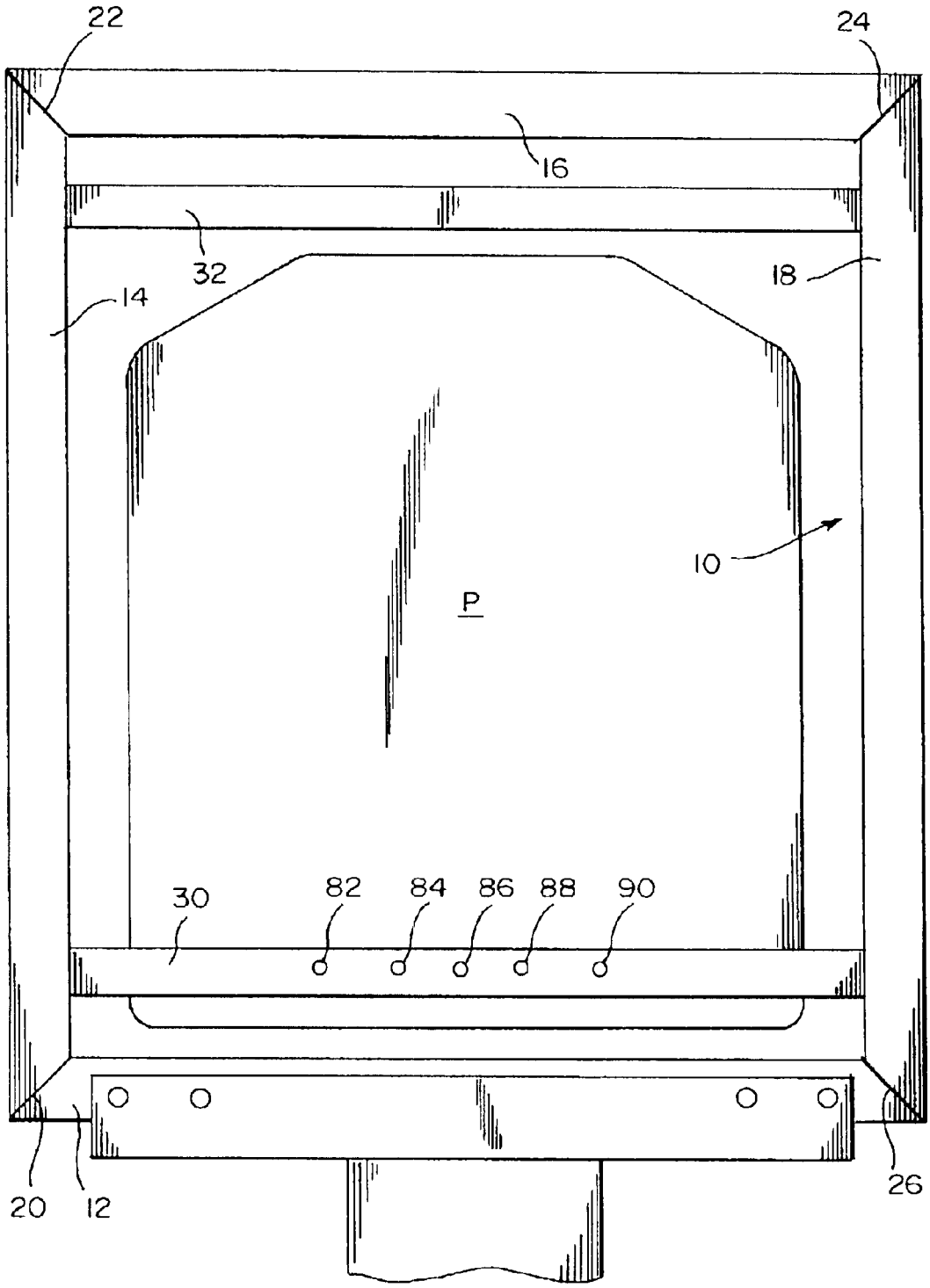
FIG. 9 is a plan view like FIGS. 4–7 but with the inner frame removed so as to expose the platen.

A platen P (FIG. 9) is positioned below the print screen 72. The platen P may be like platen 115 shown in U.S. Pat. No. 5,622,108. An object to be printed is positioned on the platen P below the frames 10,38. The stencil of the numeral "4" is centered with respect to the object to be printed. When the object to be printed is on the platen P, and the inner frame member 38 is on the support members 30,32, the screen 74 is on the object to be printed and is ready to receive ink. As is well known, the ink is put into the tray on top of the printing screen 74 and a squeegee is used for moving it back and forth over the porous forming the numeral "4". This causes the ink in the region to travel through the pores in the stencil portion of the print screen and print the numeral "4" on the object to be printed.

Figure 5:
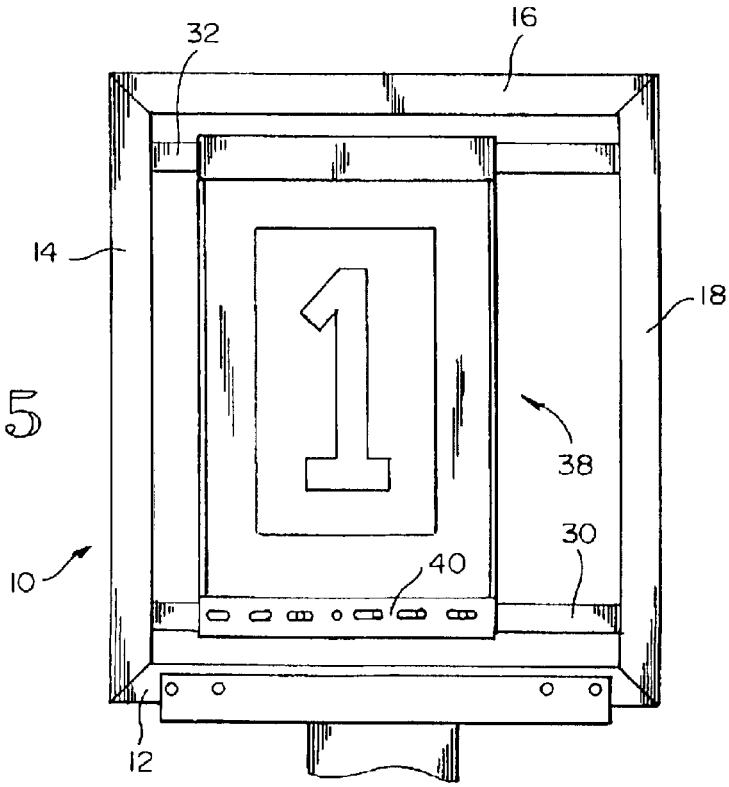
FIG. 5 is a view like FIG. 4, but showing an inner frame and printing screen that includes a numeral "1" positioned for use to print the "1" in the number "14"

Lets say, for example, that one wants to print the number "14". To do this, two inner frames 38 will be used. One will include the numeral "1" on the printing screen 74. The other will include the numeral "4" on the printing screen 74. In this example, the numeral "1" will be printed first. The object to be printed (e.g. a shirt) is placed on the platen P (FIG. 9) and the first inner frame 38 is shifted in position on the support members 30,32 to the left. The "key" locator pin opening 98 is moved into a position in which it receives locator pin 84. Locator pin 82 is now in locator pin opening 96. Locator pin 86 is within locator pin opening 100. Locator pin 88 is within locator pin opening 102. Locator pin 90 is within locator pin opening 104. In this position of the inner frame 38 within the outer frame 10, the engagement of the locator pins 82,84,86,88,90 with the locator pin openings 96,98,100,102,104 continues to perform the same function as described above but this time they lock the inner frame 38 in a position relative to the outer frame 10 that is offset to the left of the position shown by FIGS. 1 and 2. This places the numeral "1" in a proper position for its use in the number "14", as shown by FIG. 5.

Figure 4:
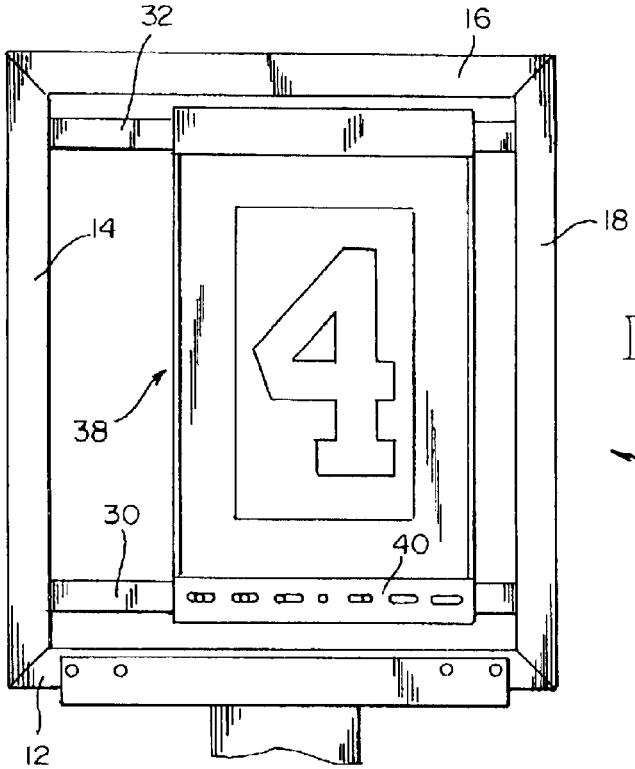
FIG. 4 is a top plan view of the screen-printing assembly of FIG. 1, showing a numeral "4" positioned for printing the "4" in the number "14"

In order to print the numeral "4" for the number "14", the inner frame 38 for the numeral "4" is shifted one pin to the right, so that locator pin 88 is within the "key" locator pin opening 98 (FIG. 4). When this is done, ink is introduced into the tray portion of the inner frame 10 and a squeegee is used to spread it over the porous pattern of the numeral "4".

Figure 6:
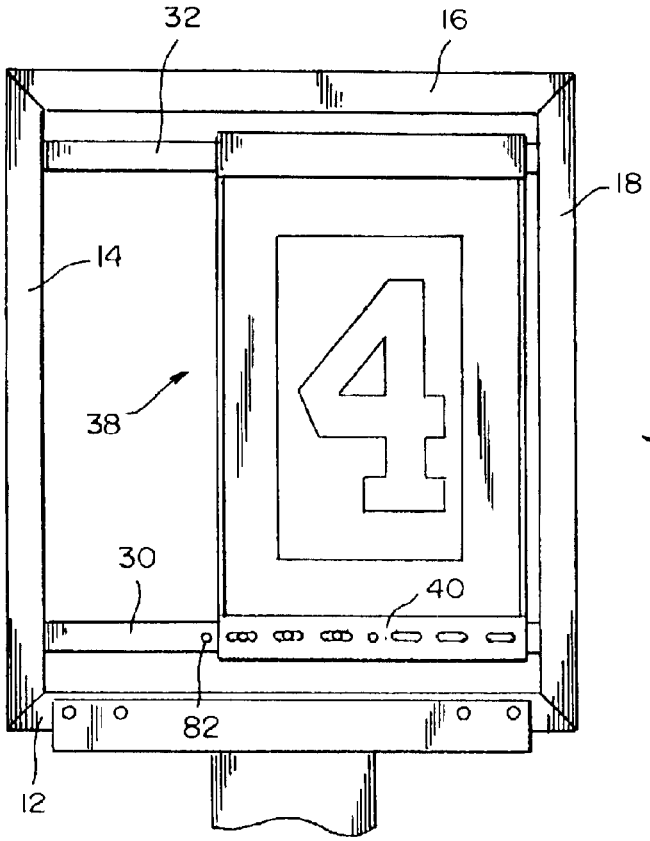
FIG. 6 is a view like FIGS. 4 and 5, but showing the inner frame, the printing screen and the numeral "4" positioned for use to print the second "4" in a number "44"

FIG. 6 shows the inner frame 38 for the numeral "4" shifted all the way over to the right, into a position in which the locator pin 90 is within "key" locator pin opening 98. Locator pin 88 is within locator pin opening 96. Locator pin 86 is within locator pin opening 94. Locator pin 84 is within locator pin opening 92. This places the numeral "4" in a proper position for its use for printing the right side "4" in the number "44."

Figure 7:
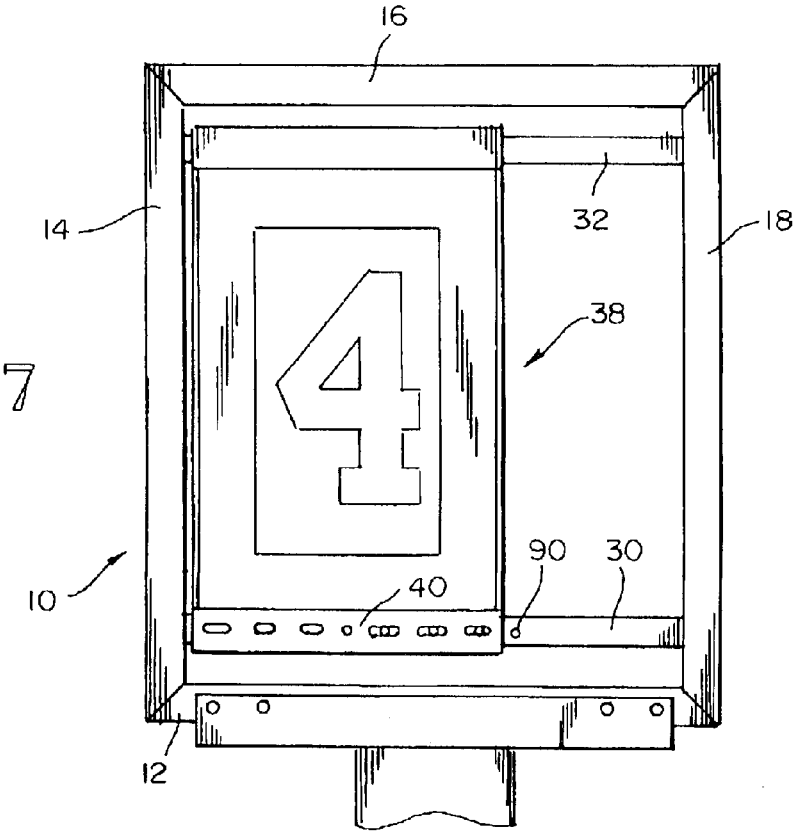
FIG. 7 is a view like FIGS. 4–6, but showing the inner frame and the printing screen and the numeral "4" positioned for printing the first "4" in the number "44"

FIG. 7 shows the inner frame 38 for the numeral "4" shifted all the way over to the left, into a position in which locator 82 is within the "key" locator pin opening 98. Locator pin 84 is within locator pin opening 100. Locator pin 86 is within locator pin opening 102. Locator pin 88 is within locator pin opening 104. This places the numeral "4" in a proper position for printing the left side "4" in the number "44."

In preferred form, ten inner frames 38 are provided. They are all identical except for the stencil. One inner frame 38 includes a stencil for the numeral "0". The other nine have stencils for the numerals 1–9. The stencils are substantially centered with respect to the inner frame 38 so that when the inner frame 38 is in a centered position with respect to the outer frame, its stencil will occupy a centered position with respect to the object to be printed.

Figure 8:
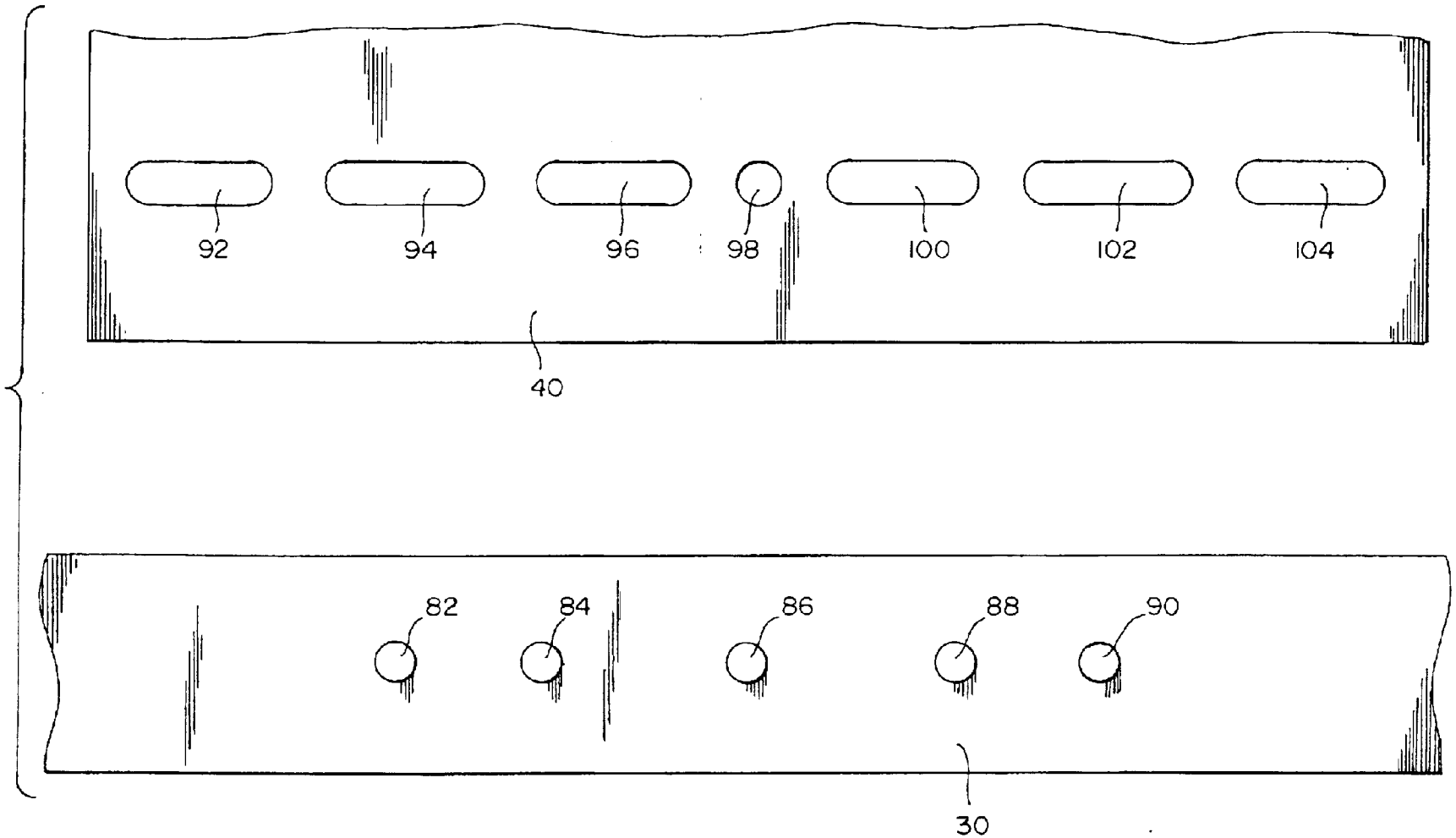
FIG. 8 is a plan view of the central portion of the mounting member that includes the locator pins and the end portion of the inner frame member that includes the locator pin openings.

FIG. 8 is an enlarged scale view of the pattern of locator pins 82,84,86,88,90 and the locator pin openings 92,94,96, 98,100,102,104 in the illustrated embodiment. As described above, in this embodiment, there are five possible positions for each inner frame 38, determined by which locator pin 82,84,86,88,90 is inserted into the "key" opening 98. Regardless of which locator pin 82,84,86,88,90 is within the "key" opening 98 at least three of the remaining four locator pins are located in the locator pin slots. In the position shown by FIG. 4, the locator pin 88 is within the "key" opening 98 and the remaining locator pins 82,84,90 are within the slots 92,94,96,100. When the inner frame 38 is in the position shown by FIG. 5, the locator pin 84 is within the "key" opening 98. The locator pins 82,86,88,90 are within the slots 96,100,102,104.

When the inner frame 38 is in the position shown by FIG. 6, the locator pin 90 is within the "key" opening 98. Locator pin 82 is outside and to the left of the inner frame 38. Locator pins 84,86,88 are within the slots 92,94,96. When the inner frame 38 is in the position shown by FIG. 7, the locator pin 82 is within the "key" opening 98. The locator pin 90 is located outside and to the right of the inner frame 38. The locator pins 84,86,88 are within the slots 100,102,104.

In another embodiment, there may be a single locator pin and a plurality of locator pin openings (e.g. five), each sized to snuggly receive the single locator pin on a selective basis. The single locator pin and the plurality of locator pin openings may be circular in shape or they may be squarer in the form of slots. In this embodiment, one or both of the end members 40,42 may include a downwardly projecting retaining lip at its outer end that is contiguous the outer edge of support 30 and/or 32. Or, supports 30,32 may both be formed with a locator pin and end members 40,42 may be both formed with locator pin openings.

In yet another embodiment, the support member 30 may be moved downwardly into a position against the side frame member 12. Then, in place of circular locator pins, the locator pins may be bar shaped members on the support member 30 that project vertically from the frame member 12. They may be equal in height and width to the locator pin 82,84,86,88,90 but are longer in the vertical direction. In this embodiment, the locator pin openings are downwardly opening recesses. Six of the recesses will be like the slots 92,94,96,100,102,104 except that they are open rather than closed at their bottoms. The "key" opening in this embodiment will be equal in width to the circular opening 98 but will be open at its bottom. It may also be desirable to repeat this pattern of elongated "keys" and open ended openings at the top of the frame assembly. This would entail moving the support member 32 outwardly into a position against side member 16 and providing it with "keys" that project downwardly from the side member 16. The upper end portion 44 of the inner frame 38 would then be provided with a "key" opening and six slot openings, each of which opens outwardly toward side member 16.

The embodiments that have been illustrated and described are only examples of the present invention and, therefore, are non-limitive. It is to be understood that many changes in the particular structure, materials and features of the invention may be made without departing from the spirit and scope of the invention. There are many other ways of adjustably fixing the inner frame member 38 in position within the outer frame member 10. The essential feature is the particular lock structure that is used will provide the necessary number of positions of the inner frame member 38 relative to the outer frame member 10 so that substantially centered single digit numbers and substantially centered double digit numbers can be printed. Therefore, it is my intention that my patent rights not be limited by the particular embodiments that have been illustrated and described herein, but rather are to be determined by the following claims, interpreted according to the accepted doctrines of patent claim interpretation, including use of the doctrine of equivalence and the doctrine of reversal of part.

What is claimed is:

1. A screen printing assembly, comprising:

an outer frame defining an inner space;

said inner space having a width dimension extending across the inner space between opposed first and second sides of the inner space, and a height dimension extending across the inner space between opposed third and fourth sides of the inner space;

a plurality of inner frames, each inner frame being sized to fit within said inner space of the outer frame and being of a width smaller than the width of the inner space of the outer frame;

each inner frame including a printing screen connected to and supported by such inner frame, each said printing screen including a stencil of a different numeral selected from the numerals 0–9;

said inner and outer frames including a plurality of locator pins on one and a plurality of locator pin openings in the other, said locator pins and locator pin openings providing a center position for the inner frame within the outer frame, and at least two addition positions on each side of the center position that are offset from the center position; and wherein said locator pin openings include a circular center opening and slots on each side of the center opening, said slots having a width dimension substantially equal to the diameter of the circular opening.

2. The screen printing assembly of claim 1, comprising a first offset position on the left side of the center position, a second offset position on the left side of the first offset position, a third offset position on the right side of the center position, and a fourth offset position on the right side of the third offset position.

3. The screen for printing assembly of claim 1, wherein the outer frame includes transverse support members on which the selected inner frame member sits, and one of said support members includes the locator pins and the inner frame members each include locator pin openings.

4. The printing screen assembly of 1, wherein each locator pin is adapted to the selectively received in the circular locator pin opening.

5. A screen printing assembly, comprising:

an outer frame including four outer side members connected together at corners and defining an inner space, and first and second support members extending across said inner space between an opposite pair of said outer side members;

an inner frame including four inner side members connected together at corners, said inner frame being sized to fit within said inner space in said outer frame;

wherein a first said inner side member is adapted to set down on and be supported by the first support member, and a second said inner side member is positioned across the inner frame from the first inner side member, and is adapted to set down on and be supported by the second support member;

wherein said first inner side member and said first support member include laterally spaced apart locator pins on one and laterally spaced locator pin openings on the other, and wherein the locator pins are selectively positionable within the locator pin openings, for adjustably affixing the position of the inner frame relative to the outer frame, lengthwise the support members;

wherein the locator pins are substantially equal in width and shape, wherein one of the locator pin openings has a shape and width that is substantially equal to the shape and width of the locator pins, and the remaining locator pin openings are elongated in the length direction of the first support member, and have a width dimension perpendicular to the length direction of the first support member that is substantially equal to the width dimension of the locator pins;

wherein the locator pins are cylindrical in shape, and wherein the said one of the locator pin openings is circular in shape and has a diameter substantially equal to the diameters of the locator pins;

wherein the remaining locator pin openings are slots having semicircular ends substantially matching the locator pins in size and curvature; and wherein there are seven locator pin openings, including a center locator pin opening that is a substantially circular opening, and wherein the remaining six openings are slots that are elongated in the direction of extent of the first support member.

6. The screen printing assembly of claim 5, wherein the slots are substantially equal in width and are substantially equally spaced apart.

7. A screen printing assembly, comprising:

an outer frame including four outer side members connected together at corners and defining an inner space, and first and second support members extending across said inner space between an opposite pair of said inner side members;

an inner frame including four inner side members connected together at corners, said inner frame being sized to fit within said inner space in said outer frame;

wherein a first said inner side member is adapted to set down on and be supported by the first support member, and a second said inner side member is positioned across the inner frame from the first inner side member, and is adapted to set down on and be supported by the second support member;

wherein said first inner side member and said first support member include laterally spaced apart locator pins on one and laterally spaced locator pin openings on the other, and wherein the locator pins are selectively positionable within the locator pin openings, for adjustably affixing the position of the inner frame relative to the outer frame, lengthwise the support members;

wherein a printing screen is connected to and supported by the inner frame;

wherein the locator pins are substantially equal in width and shape, wherein one of the locator pin openings has a shape and width that is substantially equal to the shape and width of the locator pins, and the remaining locator pin openings are elongated in the length direction of the first support member, and have a width dimension perpendicular to the length direction of the first support member that is substantially equal to the width dimension of the locator pins;

wherein the locator pins are cylindrical in shape, and wherein the said one of the locator pin openings is circular in shape and has an inside diameter substantially equal to the outside diameters of the locator pins;

wherein the remaining locator pin openings are slots having semicircular ends substantially matching the locator pins in size and curvature; and wherein there are seven locator pin openings in a row, including a center locator pin opening that is a substantially circular opening, and wherein the remaining six locator pin openings are slots.

8. The screen printing assembly of claim 7, wherein the slots are substantially equal in width and are substantially equally spaced apart.

9. A screen printing assembly, comprising:

an outer frame defining an inner space;

said inner space having a width dimension extending across the inner space between opposed first and second sides of the inner space, and a height dimension extending across the inner space between opposed third and fourth sides of the inner space;

a plurality of inner frames, each inner frame being sized to fit within said inner space of the outer frame and being of a width smaller than the width of the inner space of the outer frame;

each inner frame including a printing screen connected to and supported by such inner 5frame, each said printing screen including a stencil of a different numeral selected from the numerals 0–9;

said inner and outer frames including locator pins on one and locator pin openings on the other, said locator pins and locator pin openings providing a center position for the inner frame within the outer frame, and at least two addition positions on each side of the center position that are offset from the center position; and said assembly comprising five spaced apart locator pins and seven spaced apart locator pin openings, including a circular center opening and six slots comprising, three on each side of the center opening, said slots having a width dimension substantially equal to the diameter of the circular opening.

10. The printing screen assembly of 9, wherein each locator pin is adapted to the selectively received in the circular locator pin opening, wherein there are five positions of the inner frame relative to the outer frame.

* * * * *